US006860198B2

(12) United States Patent
Fahrenbach

(10) Patent No.: US 6,860,198 B2
(45) Date of Patent: Mar. 1, 2005

(54) PRESS HAVING A SLIDE

(75) Inventor: Juergen Fahrenbach, Aichelberg (DE)

(73) Assignee: Schuler Pressen GmbH & Co., Goeppingen (DE)

( * ) Notice: Subject to any disclaimer, the term of this patent is extended or adjusted under 35 U.S.C. 154(b) by 0 days.

(21) Appl. No.: 10/028,990

(22) Filed: Dec. 28, 2001

(65) Prior Publication Data

US 2002/0104364 A1 Aug. 8, 2002

(30) Foreign Application Priority Data

Dec. 29, 2000 (DE) ..... 100 65 255

(51) Int. Cl.[7] ..... B30B 1/02

(52) U.S. Cl. ..... 100/193; 100/237; 100/285; 100/286; 72/451; 74/38

(58) Field of Search ..... 100/193, 233, 100/237, 283, 286, 272, 285; 72/455, 452.5, 451; 74/38, 40, 44, 45

(56) References Cited

U.S. PATENT DOCUMENTS

| | | | | | |
|---|---|---|---|---|---|
| 2,087,811 | A | * | 7/1937 | Issac | 100/286 |
| 2,532,672 | A | * | 12/1950 | Michael et al. | 83/399 |
| 3,520,252 | A | * | 7/1970 | Jureit et al. | 100/272 |
| 3,695,090 | A | * | 10/1972 | Kita | 72/450 |
| 3,785,282 | A | * | 1/1974 | Kamelander | 100/257 |
| 4,184,396 | A | * | 1/1980 | Hafner | 83/623 |
| 4,434,646 | A | * | 3/1984 | Maeda et al. | 72/451 |
| 5,592,876 | A | * | 1/1997 | Son | 100/272 |
| 5,746,123 | A | * | 5/1998 | Eigenmann | 100/208 |
| 5,823,087 | A | * | 10/1998 | Eigenmann | 83/630 |

FOREIGN PATENT DOCUMENTS

| | | | | |
|---|---|---|---|---|
| DE | 531071 | * | 8/1931 | |
| DE | 0101590 | * | 2/1984 | |
| DE | 9417269 | | 3/1995 | |
| DE | 19642962 | | 4/1998 | |
| DE | 10047729 | | 4/2002 | |
| JP | 02046995 A | * | 2/1990 | 100/280 |

OTHER PUBLICATIONS

Komplettumformen, "Komplexe fertigen in einem Arbeitsgang " Produktion und Betrieb, p. 52.*
Komplettumformen, "Komplexe Teile fertigen in einem Arbeitsgang" Produktion und Betrieb, p.52.

* cited by examiner

*Primary Examiner*—Allen Ostrager
*Assistant Examiner*—Jimmy Nguyen
(74) *Attorney, Agent, or Firm*—Crowell & Moring LLP

(57) ABSTRACT

A press has a slide which can be driven by way of one or more one knee link element by a driving device in order to carry out a stroke movement. The knee link element or elements is or are connected by at least one connection element with another knee link element which is also mounted on the slide.

7 Claims, 4 Drawing Sheets

PRESS HAVING A SLIDE

BACKGROUND OF THE INVENTION

This application claims the priority of 100 65 255.7, filed in Germany, on Dec. 29, 2000 the disclosure of which is expressly incorporated by reference herein.

The present invention relates to a press having a slide which can be driven by one or more knee elements by a driving device for carrying out a stroke movement. Furthermore, the present invention relates to a multi-station press having at least two individual presses arranged behind one another and which each have at least one slide that can be drawn by one or more knee elements for carrying out a stroke movement.

Knuckle joint presses have been known for some time from the prior art. DE-PS 47229 describes, for example, such a knuckle joint press. Recently, however, these knuckle joint presses have increasingly been replaced by eccentric presses which are better suited for different tasks and which frequently achieve better results.

A multi-station press of this newer type is described in DE 198 51 743 A1. A disadvantage of such presses is, however, their high-expenditure construction, particularly as far as the separate drive for the individual presses is concerned.

SUMMARY OF THE INVENTION

An object of the present invention is, therefore, to improve the usage possibilities of presses or multi-station presses in which the slide can be driven by way of at least one knee link element by a driving device.

According to the invention, this object has been achieved by providing that the at least one knee link element is operatively connected by at least one connection element with another knee link element operatively mounted on the at least one slide.

As a result of the least one additional knee link element, which is connected with the first knee link element by way of at least one connection element, the slide, on one hand, can apply a far higher force than previously and, on the other hand, because of the kinematics, which can have a versatile design, can achieve a significantly greater variability of the press.

A multi-station press, in which the individual slides can be driven by way of at least on knee link element by a driving device, and in the case of which the at least one knee link element of a slide of a first individual press is connected by way of at least one connection element with the knee link element of the slide of the following individual press, is one currently contemplated embodiment of the present invention. It is particularly advantageous that only a single driving device is required for all individual presses or press stations.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
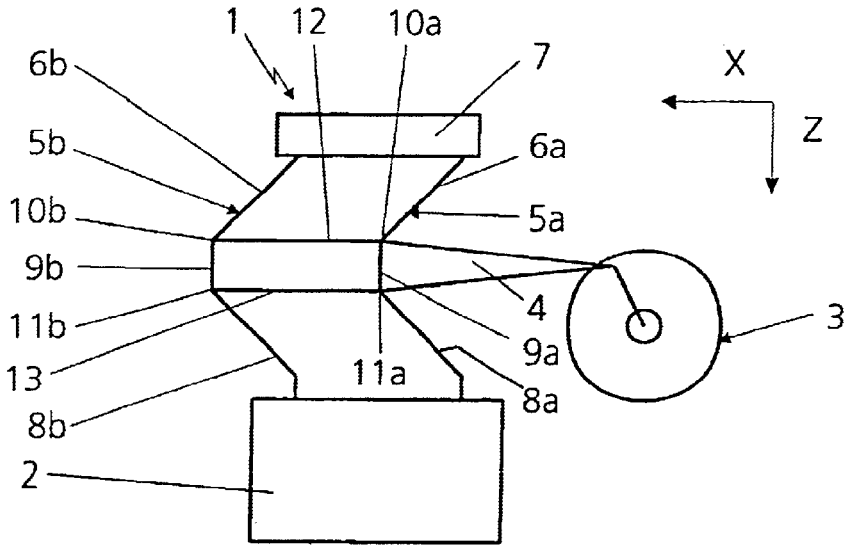
FIG. 1 is a schematic view of a press constructed according to the present invention.

In FIG. 1, a press 1 is shown having a slide 2 carrying out a stroke movement. The slide 2 is driven by a driving device 3, in the present embodiment by an eccentric drive, via a connecting rod 4. As a driving device 3, a linear drive or similar drive is contemplated as an alternative, in which case, the connecting rod 4 could be constructed in one or several parts.

The press 1 is constructed as a knuckle joint press and, for this purpose, has two knee link elements 5*a*, 5*b*which are arranged behind one another in the operative direction designated by arrow X of the connecting rod, thus the direction which is perpendicular to the moving direction designated by arrow Z of the slide 2. The two knee link elements 5*a*, 5*b*each have a first link 6*a*, 6*b* respectively which is in each case connected with an upper element 7 connected with the press 1 and disposed in the headpiece of the press 1; a second link 8*a*, 8*b* which, in each case, is mounted on the slide 2; and a third link which is called a connection link 9*a*, 9*b* and which connects the two above-mentioned links 6*a*, 6*b* as well as 8*a*, 8*b* respectively in an articulated manner. Hinge points 10*a*, 10*b* are therefore situated between the first links 6*a*, 6*b* and the connection links 9*a*, 9*b*. Hinge points 11*a*, 11*b* are situated between the second links 8*a*, 8*b* as well as the connection links 9*a*, 9*b*. In the present case, the connecting rod 4 is applied to the two hinge points 10*a*, 11*a* of the first knee link element 5*a*.

The two knee link elements 5*a*, 5*b* are connected with one another by two connection elements 12, 13 which in the illustrated embodiment extend parallel to one another, so that the movement applied by the connecting rod 4 to the first knee link element 5*a* is transmitted by way of the transmission elements 12, 13 to the second knee link element 5*b*. By connecting the knee link elements 5*a*, 5*b* behind one another, a variable and forceful drive for the slide 2 is obtained. The application of the connection elements 12, 13 takes place to the hinge points 10*a*, 10*b* of the first knee link elements 5*a* and to the hinge points 11*a*, 11*b* of the second knee link elements 5*b*. The connection element 12 is therefore arranged at the top, and the connection element 13 is arranged at the bottom, thus on the side facing the slide 2.

In the illustrated embodiment, the levers 6*a*, 8*a*, 9*a* of the first knee link element 5*a* have the same length as the levers 6*b*, 8*b*, 9*b* of the second knee link element 5*b*. Because the connection elements 12, 13 also have the same length, the slide 2 is oriented in parallel. Here, it should be noted that, on one hand, optionally one of the connection elements 12 or 13 could be eliminated and that, on the other hand, naturally also more than two knee link elements 5*a*, 5*b* respectively assigned to the slide 2 can be connected behind one another in the x-direction. The above-described relationships are partially more easily recognizable in FIG. 2.

Figure 2:
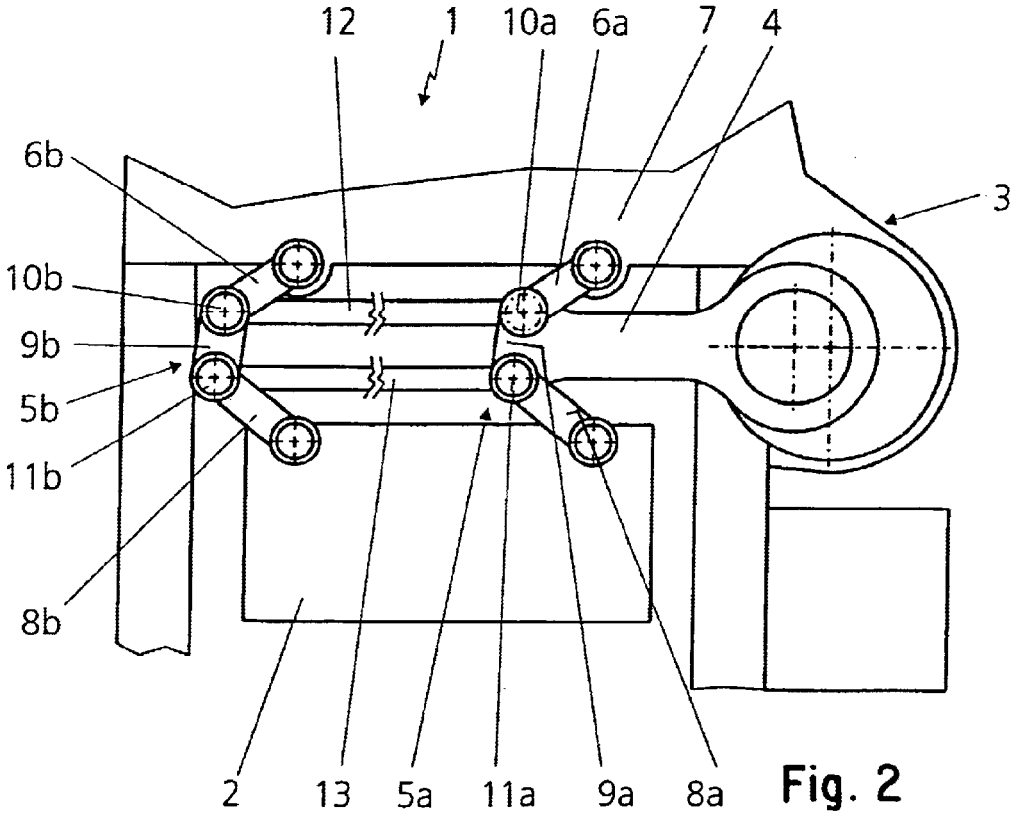
FIG. 2 is another view of the press shown in FIG. 1.
Figure 3:
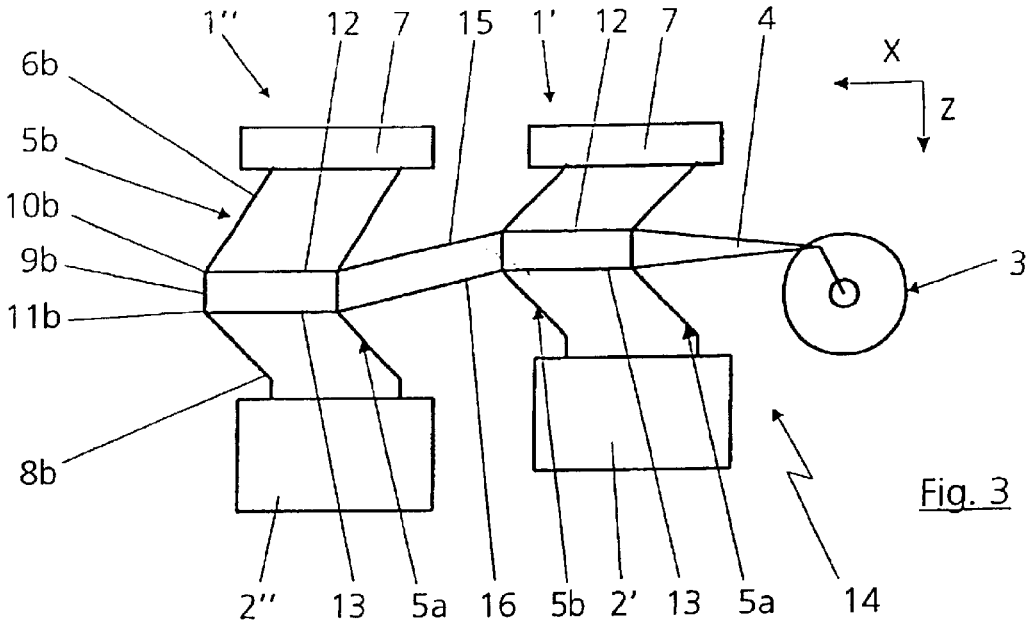
FIG. 3 is a schematic view of a multistation press having two slides.
Figure 4:
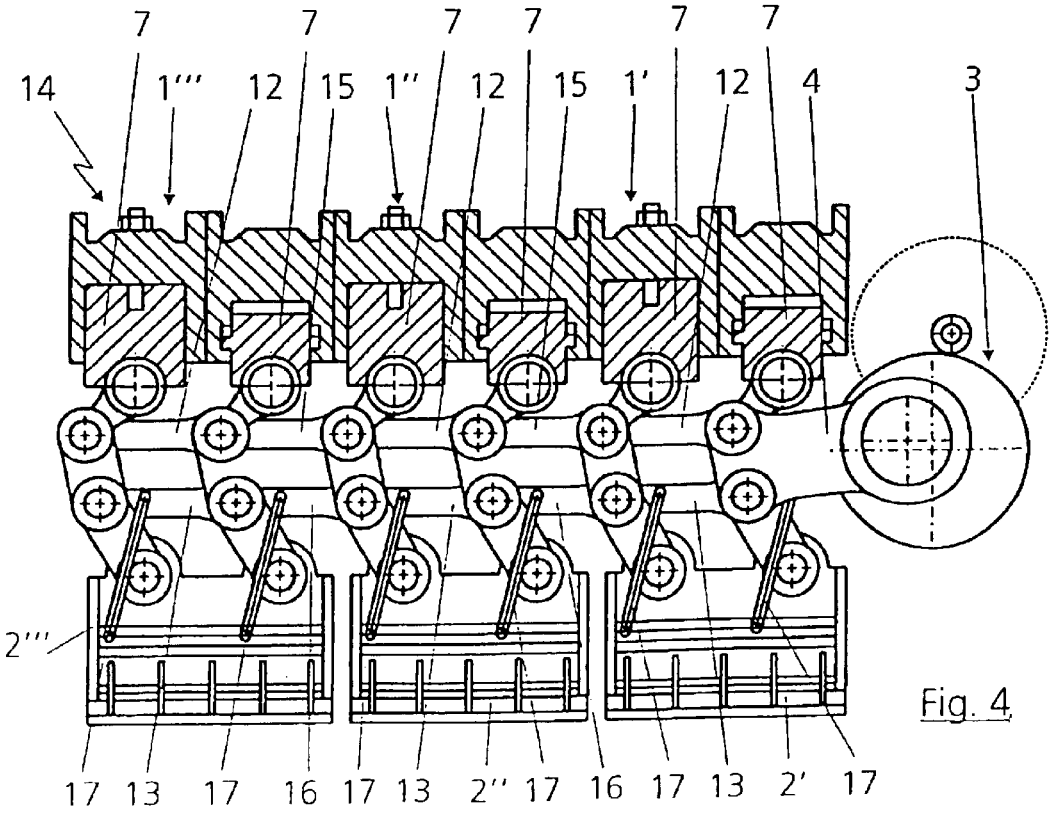
FIG. 4 is a partial cross-sectional view of a multi-station press having three slides.

FIGS. 3 and 4 illustrate a multistation press 14 which, as shown in FIG. 3, has two presses 1', 1" and, in FIG. 4 has three presses 1', 1'" of the type shown and described in FIGS. 1 and 2. For reasons of clarity, not all reference numbers used in FIGS. 1 and 2 are indicated in FIGS. 3 and 4.

Of course, any other number of press stations 1', 1", . . . arranged behind one another in the x-direction are also contemplated. In the individual press stations 1', 1", . . . respective succeeding operations are carried out, in which case respective workpiece transport devices, which are not shown but are known per se, may be arranged between the individual press stations 1', 1", . . .

In addition to the connection of the individual knee link elements 5*a*, 5*b* by way of the connection elements 12 an 13, the knee element 5*b* of one press 1' which, in the X-direction, is the farthest away from the driving device 3, is connected by way of connection elements 15, 16 with the knee link element 5*a* of the next press 1" which, in the X-direction, is situated the closest to the knee link element 5*a*. As illustrated in FIG. 4, the connection elements 15, 16 have a construction which is very similar to that of the above-described connection elements 12, 13.

In the present embodiment, the two connection elements 15, 16 have the same length. The two connection elements 15, 16 can also have different lengths or the length of at least one of the connection elements 15 or 16 can be adjusted optionally automatically. In this manner, a lagging, that is, a phase shift, of the slide 2" of the first press 1" can be adjusted in comparison to the slide 2' of the first press 1'. As a result of this lagging, the required central driving torque of the driving device 3 is reduced to permit the use of a smaller driving device 3, i.e, of a driving device 3 with a lower output.

The individual slides 2 of the respective presses 1 can be locked with one another, resulting in a completely uniform movement of the individual slides 2', 2" . . . It is therefore possible to combine the individual slides 2', 2", . . . such that virtually one very long slide 2 is created so that components can be machined in an oblong manner.

Furthermore, FIG. 4 shows that ejector pins 17 of an ejector system, which is not shown in its entirety but is known per se, for ejecting a workpiece out of the slide 2, are in each case provided at the lower connection elements 13, 16.

Figure 5:
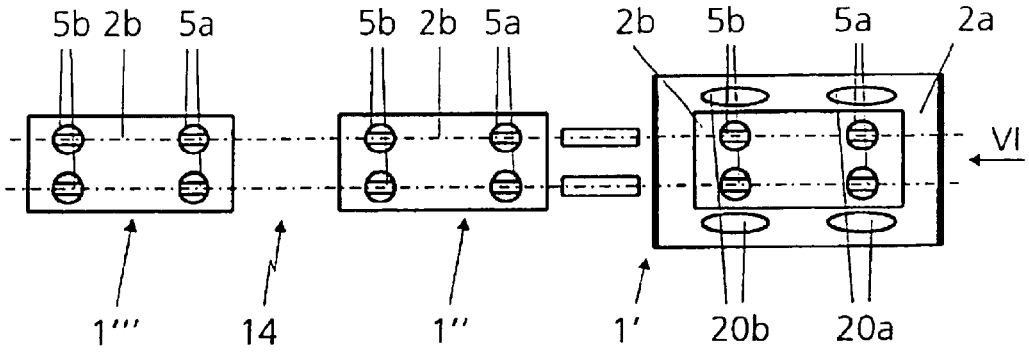
FIG. 5 is a view of a press having a slide consisting of an outer slide and an inner slide.
Figure 6:
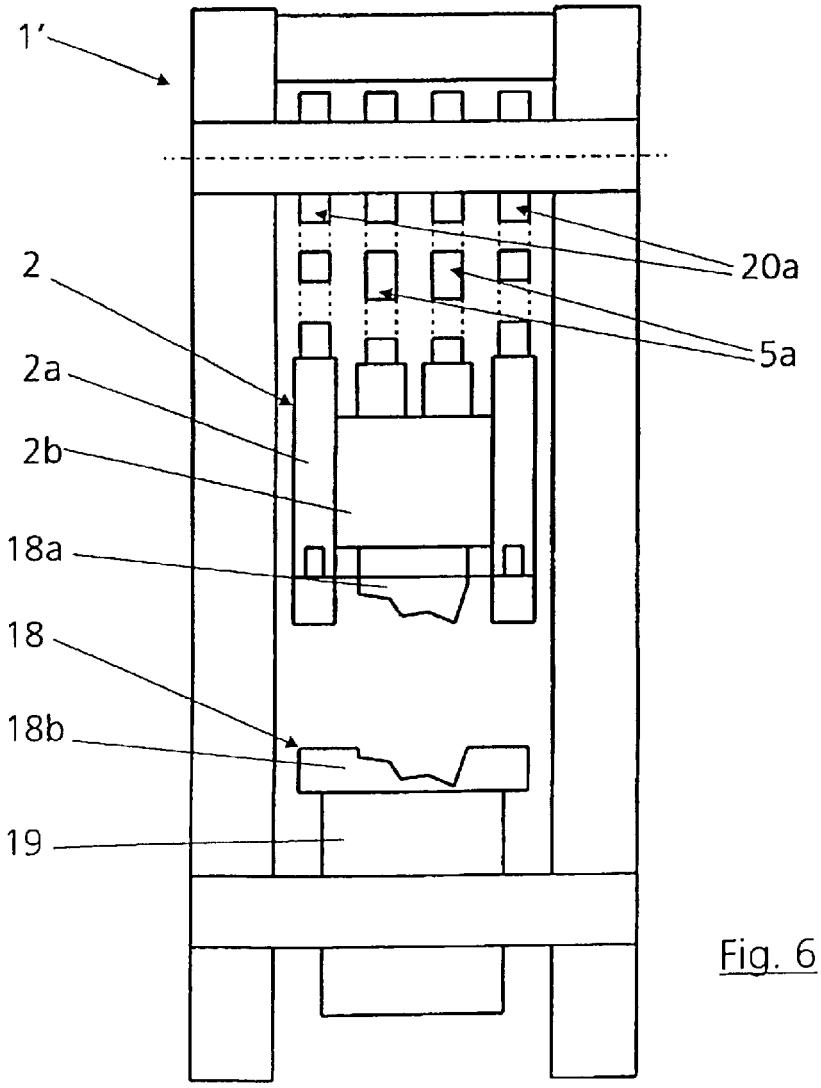
FIG. 6 is an elevational view of the press of FIG. 5 view in the direction of the arrow VI.

FIGS. 5 and 6 illustrate another embodiment of the multi-station press 14 which is provided particularly for forming sheet metal parts and here has three individual press stations 1', 1" and 1'". The multistation press 14, which will be described in the following, as an alternative, may be constructed as an individual press.

A tool 18 is shown in FIG. 6 which consists of a top part 18*a* and a bottom part 18*b*. The top part 18*a* of the tool 18 is mounted on the slide 2, and the bottom part 18*b* of the tool 18 is arranged on a bedplate 19 of the press 1. As illustrated in FIG. 5, the slide 2 is divided into an outer slide 2*a* and an inner slide 2*b*. Two first knee link elements 5*a* and two additional knee link elements 5*b* respectively as described above are assigned to the inner slide 2*b* provided for forming workpieces. The two knee link elements 5*a* and the two knee link elements 5*b* are each arranged parallel to one another and offset with respect to one another in the Y-direction. Such an arrangement with two knee link elements 5*a* and two knee link elements 5*b* is also contemplated in all other presses, particularly when the slide 2 has a relatively large breadth in the Y-direction.

Two first knee link elements 20*a* and two additional knee link elements 20*b* are assigned to the outer slide 2*a* which is used as a so-called blank holder for holding the workpiece during the forming of the latter by the inner slide 2*b*. The connection of the individual knee link elements 5*a*, 5*b* as well as 20*a*, 20*b* is implemented by corresponding elements as described with reference to FIGS. 1 to 4.

Figure 7:
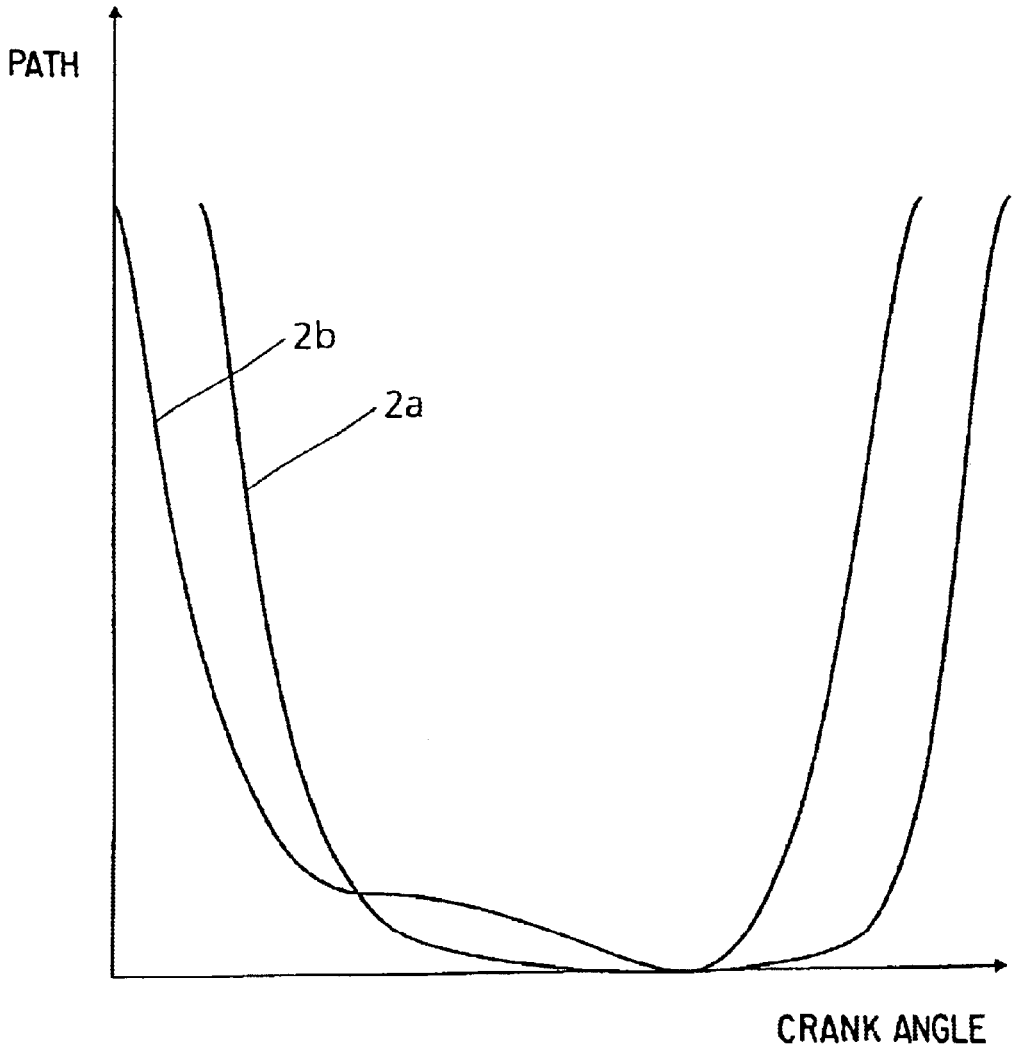
FIG. 7 is a diagram having two characteristic curves of the movement of the outer slide and the inner slide of the press constructed according to FIGS. 5 and 6.

FIG. 7 shows the two characteristic curves of the outer slide 2*a* and of the inner slide 2*b*; i.e., the path covered by the slide 2*a*, 2*b* respectively is entered over the crank angle, and it is illustrated that the outer slide 2*a* rests on the workpiece much longer than the inner slide 2*b*, which has a very brief well time on the workpiece and is moved upward again very rapidly. As a result of the holding of the workpiece by way of the outer slide 2*a*, there is prevented movement of the workpiece that has a negative influence on the forming operation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Multi-station press, comprising a plurality of individual presses arranged behind one another, with each press having a press frame, a slide, and a link system for driving the slide of each of the presses respectively, each link system including first knee link elements and second knee link elements, each of the first and second knee link elements being operatively connected between the press frame and the slide of each of the presses respectively, connection means for operatively connecting the first knee link elements and the second knee link elements of each of the individual presses, and an eccentric driving device connected to the first knee link elements of a first press of the individual presses to control tilting movement of the first knee link elements and second knee link elements for carrying out an appropriate stroke movement in each of the individual presses, wherein connection elements connect the second knee link elements of the first press of the individual presses with the first knee link elements of a second press of the individual presses adjacent the first press of the individual presses.

2. Press accordingly to claim 1, wherein the eccentric driving device is connected by a connecting rod to the first knee link elements of the first press by way of at least one hinge point.

3. Multi-station press according to claim 1, wherein at least one of the connection elements connects at least one of the second knee link elements that are operatively mounted on the slide of the first press of the individual presses with at least one of the first knee link elements mounted on the slide of second press of the individual presses.

4. Multi-station press according to claim 3, wherein the connection elements have the same length.

5. Multi-station press according to claim 3, wherein the connection elements have different lengths.

6. Multi-station press according to claim 3, wherein at least one of the connection elements has an adjustable length link.

7. Multi-station press according to claim 1, wherein the slides are arranged side-by-side and are configured to be lockable with one another.

* * * * *